United States Patent [19]

Moore

[11] 4,151,734

[45] May 1, 1979

[54] PROCESS FOR MANUFACTURING WELDING NECKS AND THE LIKE

[76] Inventor: Charles H. Moore, 645 Matanzas Ct., Fort Myers Beach, Fla. 33931

[21] Appl. No.: 836,147

[22] Filed: Sep. 23, 1977

[51] Int. Cl.[2] ..... B21C 23/01; B21C 23/18; B21C 25/04; B21C 35/04

[52] U.S. Cl. ..... 72/358; 72/343; 72/264; 72/255

[58] Field of Search ..... 72/253, 254, 255, 264, 72/352, 353, 358, 360, 377, 267, 324, 338, 354, 356, 326, 327, 331, 333

[56] References Cited

U.S. PATENT DOCUMENTS

| | | | |
|---|---|---|---|
| 1,040,160 | 10/1912 | Davis | 72/358 |
| 2,909,281 | 10/1959 | Koskinen | 72/358 X |
| 3,149,416 | 9/1964 | Moore | 72/377 |
| 3,365,997 | 1/1968 | Price | 72/267 |
| 3,412,593 | 11/1968 | Price | 72/254 X |
| 3,771,480 | 11/1973 | Johnson | 72/360 |

FOREIGN PATENT DOCUMENTS

| | | | |
|---|---|---|---|
| 576663 | 1958 | Italy | 72/358 |
| 498089 | 5/1976 | U.S.S.R. | 72/353 |

*Primary Examiner*—C. W. Lanham
*Assistant Examiner*—D. M. Gurley

[57] ABSTRACT

A far less expensive process of manufacturing heavy-duty welding necks, nozzles, and similar connector elements comprising cylindrical bodies with a radial flange at one end, is provided through the utilization of a centered metal-displacement disc which contacts a radially flanged heated billet after the forging operation and forces the metal under the centered disc and interiorly of the radially-flanged portion into the die cavity and around a rounded centrally disposed supporting member which initially is in contact with the underside of the work-piece. This forward displacement action is continued until the advance portion of the work-piece contacts a circular forging knife which is carried on the interior of the female forging die member. The female forging die member is then lifted, after which the metal-displacement disc proceeds to push the remaining portion of the work-piece and the rounded centrally disposed supporting member through the area within the circular forging knife and through and out of the female forging die member.

Besides the benefit of the reduced cost of manufacture, the forward displacement in the manner described kneads or works the metal of the heated work-piece to an extent which produces much improved metallurgical results.

5 Claims, 3 Drawing Figures

PROCESS FOR MANUFACTURING WELDING NECKS AND THE LIKE

This invention relates to connector elements and particularly to the manufacture of heavy-duty welding necks, nozzles, and other cylindrical bodies which are provided at one end with a radical flange, and which are widely used in industry for a variety of purposes.

Welding necks are very widely used in connection with industrial pressure vessels of one sort or another, being welded to an opening in the vessel and provided at its outer end with a radial flange having bolt holes for enabling its connection to a pipeline or other instrumentality.

The sizes of welding necks, and similar connector elements, vary considerably, the larger sizes usually being somewhat more difficult to produce in substantial volume and various methods have been proposed for their economical manufacture without reduction in quality.

The present invention seeks to more economically manufacture welding necks and comparable cylindrical products with a radially flanged end, which are of conventional configuration and possessed of the highest quality in all respects.

Another object is to provide a process of the type described which may be practiced with apparatus which is essentially economical, and quick and easy to operate by a minimum of workers in the forge shop.

The foregoing and other objects and advantages will become more readily understood from the following description and annexed drawings wherein like reference characters represent like parts, and wherein.

Figure 1:
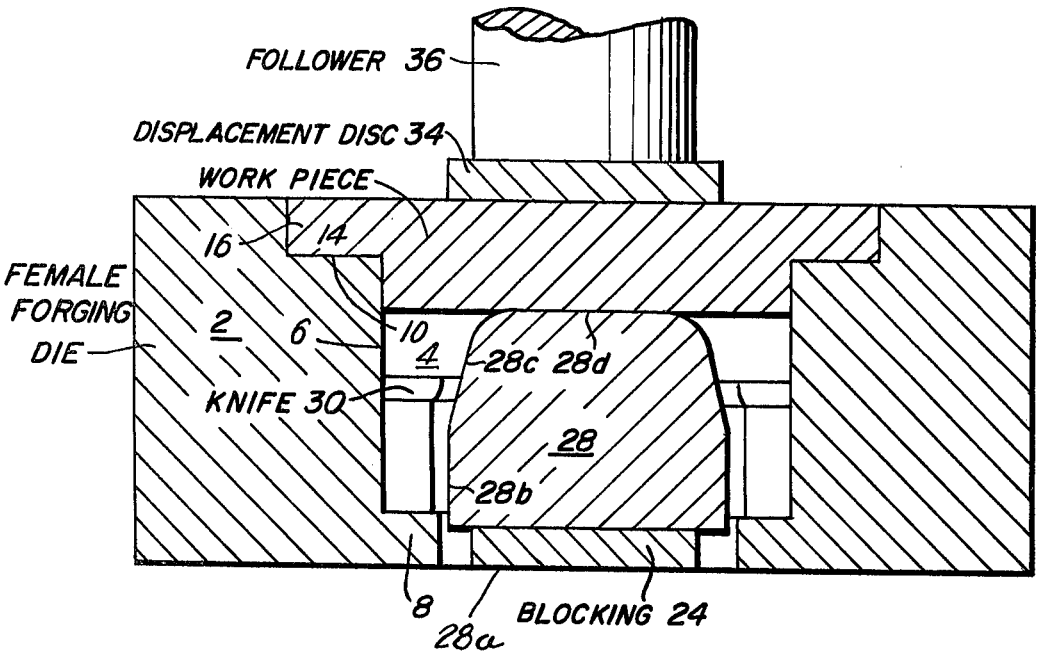
FIG. 1 is an elevational view, partly in section, of a form of apparatus which may be satisfactorily employed to practice the novel process.

Referring more particularly to the drawing, the numeral 2 generally designates the female forging die member which is employed in practicing the process of the present invention, the same being shown as round, open at both ends, and with a central die cavity generally indicated at 4.

The main body portion of the die cavity is defined by the inner wall 6 of the female forging die member 2, and the lower end of this wall terminates in a relatively narrow horizontal step which extends radially inward, as shown at 8.

The upper end of the female forging die member 2 is provided with a substantially wider outwardly-extending horizontal step 10 which is completely open at the top for the purpose of receiving the outwardly-extending or radial flange 16 which forms an integral part of the work-piece 14 which is heated to forging temperature before being placed in the top of the female forging die member in the manner well-known in the art.

Referring to the lowermost portion of FIG. 1 of the drawings, there is disposed upon the bed of a forging press which may be of entirely conventional design, a round blocking plate 24 of a diameter which is less than the diameter of the bottom opening of the cavity of the female forging die member 2, and upon it there is disposed a vertically extending round supporting member 28 which is of larger diameter than the round blocking plate, as shown.

It is an important feature of the invention that the periphery of the round supporting member 28 be spaced from the periphery of the relatively narrow horizontally extending step 8 at the bottom of the interior of the cavity of the female forging die member 2.

As will be referred to hereinafter, the round blocking plate 24 may, under certain circumstances, be larger than the diameter of the vertically extending supporting member 28.

As shown in FIG. 1, the lower portion of the vertically extending round supporting member 28 is substantially cylindrical for approximately one-half its height, as indicated at **28*b*, while the upper half is frusto-conical, as shown at 28*c*, terminating in a relatively flat upper extremity 28*d***.

Figure 2:
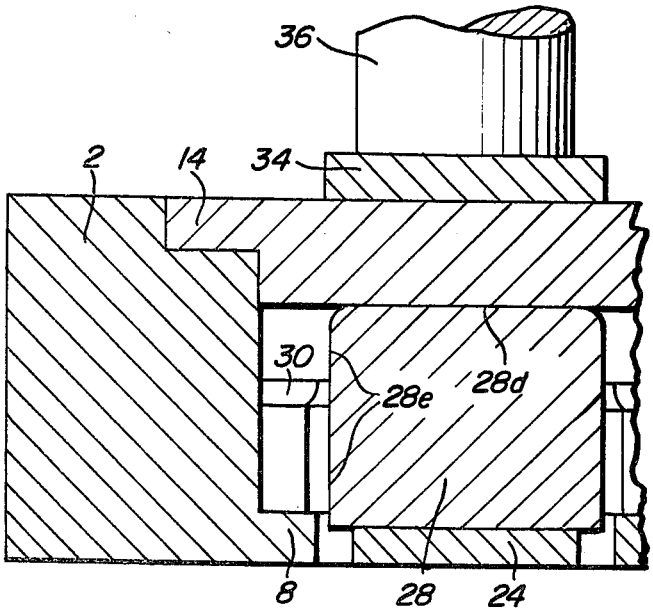
FIG. 2 is a fragmentary elevational view illustrating a modification which will be described hereinafter.

In FIG. 2, the substantially cylindrical portion of the vertically-extending round supporting member 28 is shown at **28*e* as extending almost to the top thereof, terminating in the relatively flat upper extremity 28*d***.

It is important that in any event the relatively flat upper extremity **28*d* of the vertically-extending round supporting member 28 make contact with the underside of the work-piece 14** at the time of commencement of the forging action.

The relatively narrow horizontally extending step 8 supports a circular forging knife 30 which is disposed immediately opposite the frusto-conical section **28*c* (FIG. 1) or 28*e* (FIG. 2) of the vertically extending round supporting member 28**.

The inner diameter of the circular forging knife 30 on the horizontal step 8 is, of course, only slightly smaller than the diameter of the space which is circumscribed by the horizontal step 8, thereby permitting the exterior of the forwardly displaced work-piece 14 to pass therethrough during the completion of the forging operation.

The height of the hub portion which carries the upper radial flange 16 of the work-piece 14 is predetermined, depending upon the desired length of the cylindrical barrel or body portion of the end product.

As shown at the upper end of FIG. 1 of the drawings, a metal-displacement disc 34 is centered upon the top of the solid round work-piece 14, the diameter of said metal displacement disc being the same as the diameter of the cylindrical portion **28*b*, but slightly less than the inside diameter of the circular forging knife 30**.

The lower end of a round forging press follower 36 is centered upon the metal-displacement disc 34, the same being of a diameter which is slightly less than that of the metal displacement disc.

The upper and movable element or platen of the foring press (not shown) is lowered onto the top of the round forging press follower 36, and the metal-displacement disc 34 is pushed downwardly to force the heated metal beneath it to flow into the cylindrical cavity of the die-forming instrumentalities which terminate at the upper surface of the circular forging knife 30. At this point the female forging die member 2 is raised and the blocking plate 24 removed, thus providing space beneath the apparatus so that the supporting member and the metal-displacement disc 34 can be "punched-out" through the circular forging knife 30.

The downward movement of the metal-displacement disc 34 is continued while the female forging die member 2 is raised until all of the forwardly displaced metal becomes part of the forged end product except for a small amount of scrap on top of the vertically extending round supporting member 28 and around its tapered portion, thus, the supporting member 28 is surrounded with hot metal and remains there when the female forging die is raised.

The process as described will be found to be particularly advantageous when utilized to produce forgings of the type described wherein the cylindrical or barrel portion is of 10-inch inside diameter or larger; for example welding necks of the 16-inch, 18-inch, 20-inch, and 24-inch sizes.

The input weight (starting weight of the billet or workpiece) in the present process is 40% to 50% less than the input weight necessary to produce an end product of the same size by conventional pipe-punching methods of the type shown and described in my U.S. Pat. No. 2,348,179 dated May 2, 1944.

The work-piece 14 may be provided from storage, heated to forging temperature, and then disposed in the female forging die member 2 as shown in FIG. 1.

As an alternative, there may be used a hot rounded billet (with a straight periphery as viewed in elevation) and of a diameter which is slightly less than the diameter of the cavity of the female forging die member 2 which is blocked-up solid in the center up to the height of the hub portion which is desired in the forged end product. Then that portion of the rounded billet (with straight periphery) which extends above the female forging die member 2 is mashed-down with a flat disc (not shown) which is of sufficient diameter to cover at least the horizontal step 10 at the top of the female forging die member 2, utilizing the upper and movable platen of the forging press. Thus, the metal of the billet is upset to fill the bolt-flange recess provided by the horizontal step 10.

At this point, the resultant work-piece 14 is removed from the female forging die member 2 and reheated.

Figure 3:
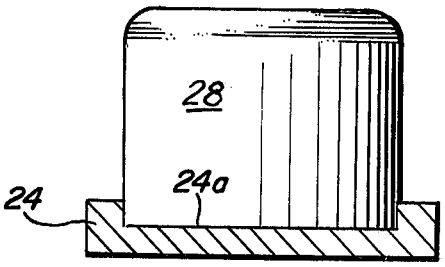
FIG. 3 is a sectional elevation illustrating another modification of the apparatus.

The blocking referred to hereinbefore is removed, and then the secondary instrumentalities are added; e.g. the circular forging knife 30, the vertically extending round supporting member 28, and blocking in the form of the round blocking plate 24. As shown in FIG. 3, the round blocking plate 24 may be provided with a centrally disposed circular recess 24*a* of say, ¼ inch depth for receiving the round bottom of the vertically extending supporting member 28, thus serving as a centering device. Other types of centering device may, of course, be substituted, the same comprising, as such, no part of the present invention.

Only a small amount of scrap results; and the entire method is characterized by great savings in weight of the metal which has to be utilized.

Much improved metallurgical qualities result from the kneading or working of the highly-heated metal during the forward displacement thereof.

In addition, the apparatus employed is essential economical, and quick and easy to operate by a minimum of workers in the forge shop, as many forge shops already have the female dies to make necks by other methods such as the hollow pipe punch method.

Having thus described the invention what I claim as new and desire to secure by Letters Patent is:

1. The process of manufacturing, with a forging press, welding necks and similar cylindrical high pressure resistant bodies with a radial flange at one end which includes the use, on the bed of a forging press, of a vertically disposed open-ended substantially cylindrical steel femal forging die member having an inwardly extending open step at its uppermost extremity; said process consisting essentially in disposing a circular forging knife within the cavity of the female forging die member and at a predetermined height with respect to the lower end of the latter; firmly maintaining in position from below, and within the cavity of the female forging die member, a round vertically extending supporting member of slightly less diameter than the circular forging knife and wherein the round vertically extending supporting member possesses a lower cylindrical wall merging upwardly into an upper portion with rounded edges which terminate in a relatively flat area; placing in the upper end of the cavity of the female forging die member a round and solid heated billet having a lower peripheral portion which is of slightly less diameter than the most adjacent portion of the cavity of the female forging die member and an uppermost outwardly-extending flange the lower surface of which substantially fully occupies the inwardly extending horizontal open step at the uppermost extremity of the female forging die member; disposing within the cavity of the female forging die member and atop the heated billet a round metal-displacement disc which is of substantially the same diameter as the widest portion of the aforementioned vertically extending round supporting member; moving the metal-displacement disc downwardly with the aid of the upper movable element of the forging press and an intermediately disposed round forging press follower of a diameter which is somewhat less than the diameter of the metal displacement disc until the metal of the heated billet directly below said metal displacement disc is extruded to entirely fill the cavities therebelow which terminate at the upper surface of the circular forging knife and the adjacent portions of the aforementioned supporting member; raising the female forging die member; and with the aid of the upper movable element of the forging press and the round forging press follower pushing the metal, below the metal-displacement disc, and the vertically extending supporting member through the circular forging knife to form the cylindrical body of the end product.

2. The process of claim 1 wherein the bottom of the round vertically extending supporting member is blocked from below with a disc which is not materially larger in diameter than the diameter of the round vertically extending supporting member.

3. The process of claim 1 wherein the upper end of the cylindrical wall of the vertically extending round supporting member merges at its upper end into a centrally disposed flat upper extremity through an intermediately disposed frusto-conical section.

4. The process of claim 1 wherein the exterior of the vertically extending round supporting member is formed of a lower cylindrical wall and a frusto-conical upper wall which connects with the centrally disposed rounded and flat upper extremity.

5. The process of manufacturing with a forging press welding necks and similar cylindrical bodies with a radial flange at one end which includes the use of an open-ended female forging die member having a generally cylindrical bore with a relatively narrow inwardly extending horizontal step adjacent to its lower end and a substantially wider inwardly extending horizontal open step at its upper end; disposing a circular forging knife upon the relatively narrow inwardly extending horizontal step adjacent the lower end of the open-ended female forging die member; disposing upon a round blocking plate of lesser diameter than the lower opening of the female forging die member a vertically extending round supporting member of smaller diameter than the round blocking plate but slightly less diameter than the inner diameter of the circular forging knife, and having a cylindrical wall merging at its upper end into a flat centrally disposed upper extremity; placing the vertically extending round blocking plate and the superposed round supporting member of smaller diameter on the bed of a forging press; disposing the bottom of the open-ended female forging die member on the bed of the forging press in surrounding relationship to the round blocking plate and the superposed vertically extending round supporting member; placing in the upper end of the female forging die member a solid round heated billet having a lower peripheral portion which is of slightly less diameter than the interior of the female forging die member and an upper flange portion which substantially fully occupies the inwardly extending horizontal open step at the upper end of the female forging die member; centering on the top of the aforementioned heated billet a metal-displacement disc which is of substantially the same diameter as that of the lower cylindrical wall of the round supporting member on the round blocking plate in the bottom of the female forging die member; moving the metal-displacement disc downwardly with the aid of the upper movable element of the forging press and an intermediately disposed round forging press follower of a diameter which is somewhat less than the diameter of the metal displacement disc until the metal of the heated billet directly below the metal displacement disc is extruded to entirely fill the cavities therebelow which terminate at the upper surface of the circular forging knife and the adjacent portions of the aforementioned supporting member; raising the female forging die member; and with the aid of the upper movable element of the forging press and the round forging press follower pushing the metal, below the metal-displacement disc, and the vertically extending supporting member through the circular forging knife to form the cylindrical body of the end product.

* * * * *